US009134099B2

(12) United States Patent
Tseng

(10) Patent No.: US 9,134,099 B2
(45) Date of Patent: Sep. 15, 2015

(54) NET THROWING DEVICE

(71) Applicant: STARJET Technologies Co., LTD, Jintan, Jiangsu (CN)

(72) Inventor: Jui-Fu Tseng, Yilan (TW)

(73) Assignee: STARJET TECHNOLOGIES CO., LTD., Jintan (CN)

( * ) Notice: Subject to any disclaimer, the term of this patent is extended or adjusted under 35 U.S.C. 154(b) by 46 days.

(21) Appl. No.: 14/108,253

(22) Filed: Dec. 16, 2013

(65) Prior Publication Data

US 2015/0168107 A1 Jun. 18, 2015

(51) Int. Cl.
*F41H 13/00* (2006.01)
*F41B 11/00* (2013.01)

(52) U.S. Cl.
CPC ..... *F41H 13/0006* (2013.01); *F41B 11/00* (2013.01)

(58) Field of Classification Search
CPC ..... F42B 12/66; F42B 12/68; F41B 11/83; F41B 15/10; F41H 13/0006
USPC ..... 124/56, 59; 102/502, 501, 503, 504; 89/1.41, 1.34; 42/1.08, 106, 105; 86/50; 43/58
See application file for complete search history.

(56) References Cited

U.S. PATENT DOCUMENTS

| | | | | | |
|---|---|---|---|---|---|
| 4,559,737 | A * | 12/1985 | Washington | 43/59 |
| 4,912,869 | A * | 4/1990 | Govett | 42/105 |
| 5,326,101 | A * | 7/1994 | Fay | 463/47.4 |
| 5,460,155 | A * | 10/1995 | Hobbs, II | 124/56 |
| 5,898,125 | A * | 4/1999 | Mangolds et al. | 102/439 |
| 6,854,374 | B1 * | 2/2005 | Breazeale | 86/50 |
| 6,904,838 | B1 * | 6/2005 | Dindl | 89/1.1 |
| 7,305,981 | B1 * | 12/2007 | Lin | 124/59 |
| 7,398,617 | B2 * | 7/2008 | Mattox | 43/58 |
| 8,186,276 | B1 * | 5/2012 | Olden et al. | 102/504 |
| 8,857,305 | B1 * | 10/2014 | Tseng | 89/1.34 |
| 2002/0134365 | A1 * | 9/2002 | Gray | 124/56 |
| 2010/0132580 | A1 * | 6/2010 | Nazdratenko | 102/502 |
| 2012/0192707 | A1 * | 8/2012 | Rogers et al. | 89/36.08 |
| 2014/0331984 | A1 * | 11/2014 | Brahler et al. | 124/76 |

* cited by examiner

*Primary Examiner* — Samir Abdosh
*Assistant Examiner* — John D Cooper

(57) ABSTRACT

A net throwing device for use in combination with a compressed air powered launching device is provided with a pod including an axial space, tubes disposed around the axial space, and a slot formed on an edge; a net disposed in the axial space; weights each disposed in one of the tubes; and a casing including a forward oriented projection on an edge of a front end, the projection being fitted in the slot to secure the casing and the pod together, and a protrusion adjacent to the forward oriented projection. At least one of the tubes is inclined with respect to an axis of the axial space. At least one of the tubes is parallel to the axis of the axial space.

4 Claims, 16 Drawing Sheets

NET THROWING DEVICE

BACKGROUND OF THE INVENTION

1. Field of the Invention

The invention relates to riot control equipment and more particularly to a net throwing device.

2. Description of Related Art

Law enforcement officers have long used less lethal weapons (e.g., batons and whips) to disperse crowds and detain rioters. Since recent decades, riot control officers have also used tear gas, pepper spray, rubber bullets, and electric tasers.

There is a typical net gun utilizing a stock, an action member, a firing chamber, a manifold, and a plurality of barrels connected to the manifold is disclosed. Each barrel is configured to receive a projectile having an inner bore that is closely fitted over the external diameter of the barrel. Each barrel has a restrictor at the manifold end. Apertures are formed through the wall of the projectile adjacent to the barrel.

While it has some utility, improvements in these products are desired, and these improvements are provided by the invention.

SUMMARY OF THE INVENTION

It is therefore one object of the invention to provide a net throwing device for use in combination with a compressed air powered launching device, comprising a pod comprising an axial space, a plurality of tubes disposed around the axial space, and a slot formed on an edge; a net disposed in the axial space; a plurality of weights each disposed in one of the tubes; and a casing comprising a forward oriented projection on an edge of a front end, the forward oriented projection being fitted in the slot to secure the casing and the pod together, and a protrusion adjacent to the forward oriented projection; wherein at least one of the tubes is inclined with respect to an axis of the axial space, and at least one of the tubes is parallel to the axis of the axial space.

The above and other objects, features and advantages of the invention will become apparent from the following detailed description taken with the accompanying drawings.

DETAILED DESCRIPTION OF THE INVENTION

Figure 1:
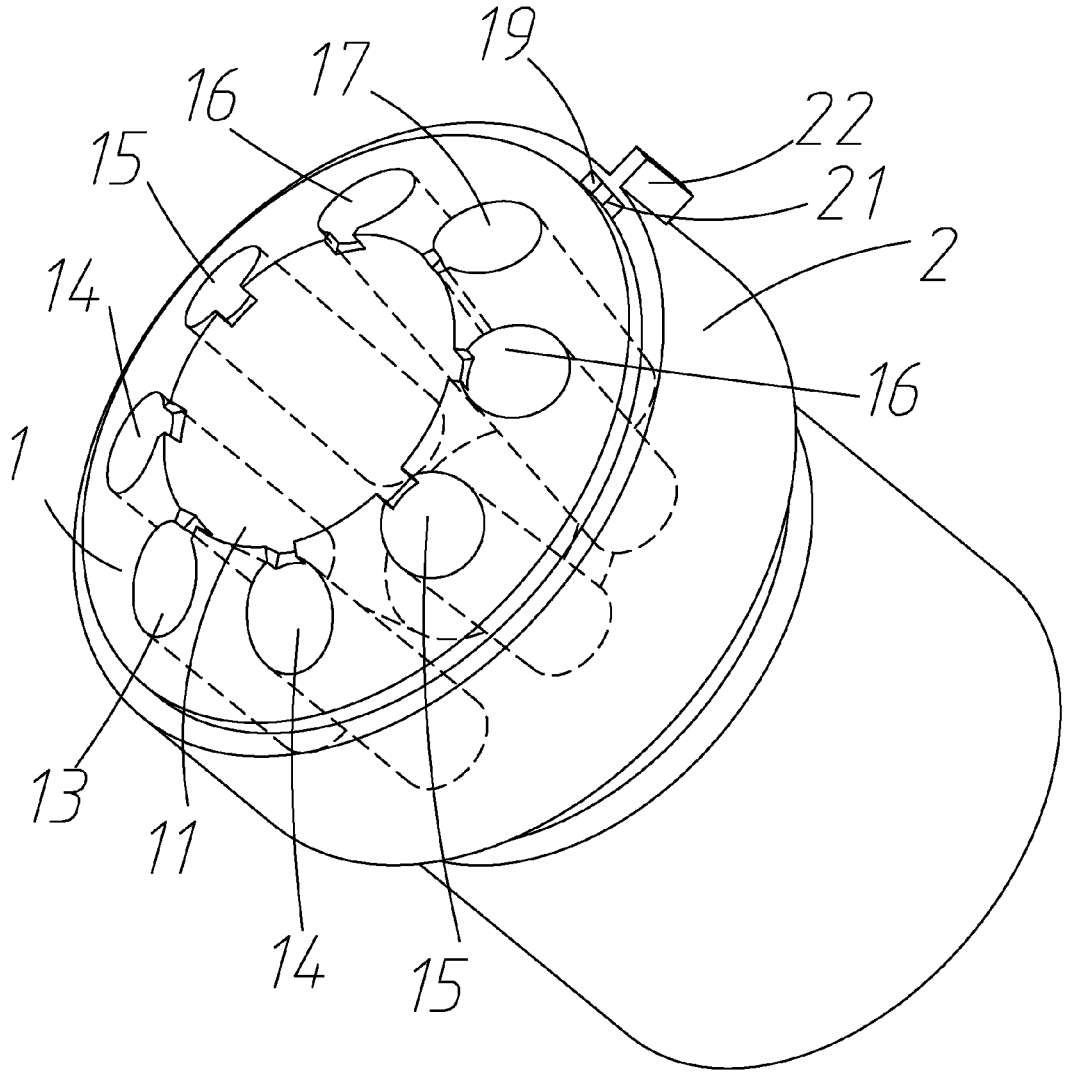
FIG. 1 is a perspective view of a net throwing device according to the invention.
Figure 2:
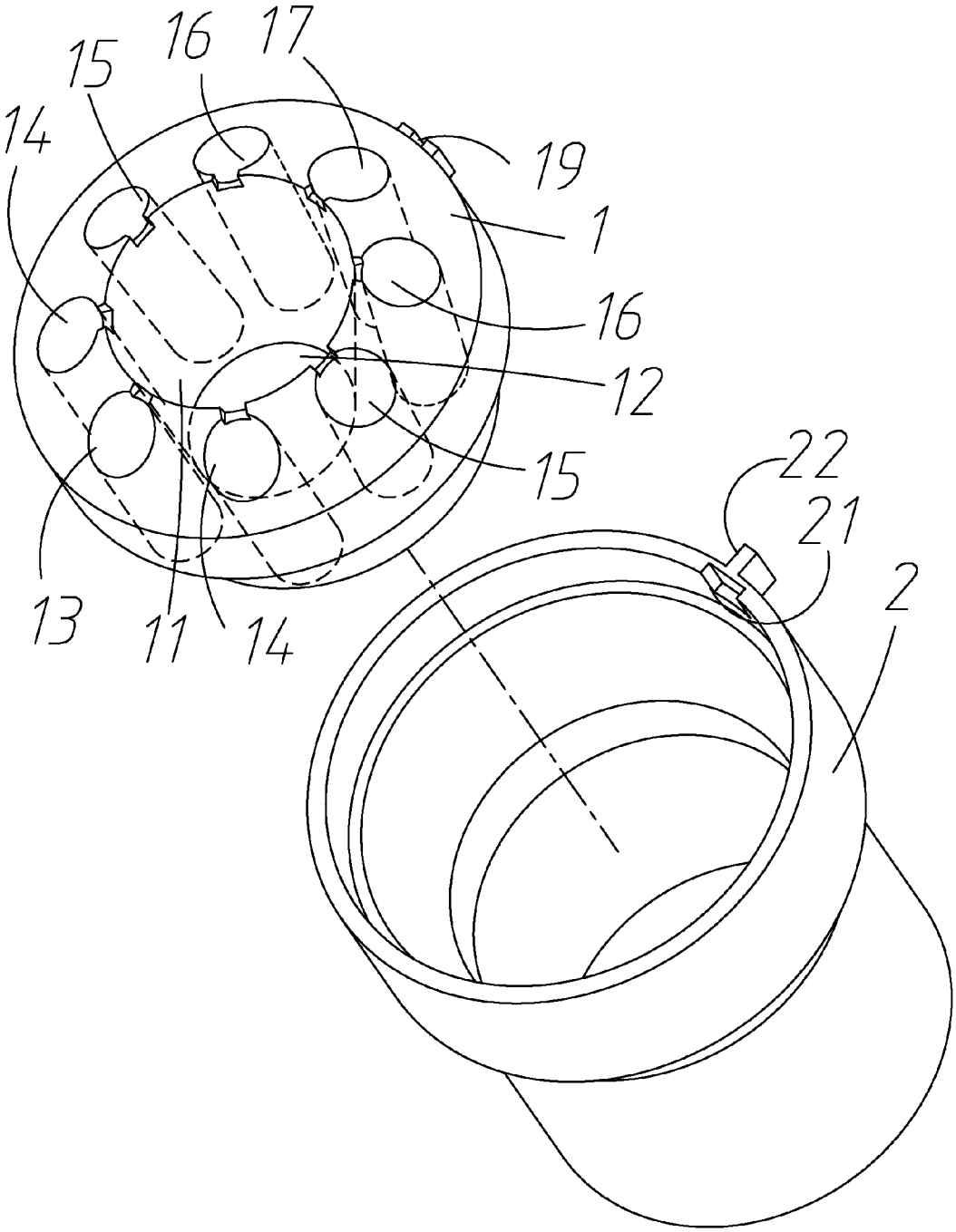
FIG. 2 is an exploded view of the net throwing device.

Referring to FIGS. 1 to 9B, a net throwing device in accordance with the invention comprises the following components as discussed in detail below.

A pod 1 has a circular longitudinal section and comprises an axial space 11 having a widened mouth and adapted to receive a net 4, a rear channel 12 communicating with the space 11, a plurality of tubes 13, 14, 15, 16 and 17 formed around the space 11 and each of the tubes 13-17 having a rear tunnel 18 communicating with itself, a plurality of weights 5 (e.g., weights 51, 52 and 53) each disposed in one of the tubes 13 to 17, a plurality of ropes 40 each interconnecting the weight 5 and the net 4, and a slot 19 on a circumferential edge.

Figure 4:
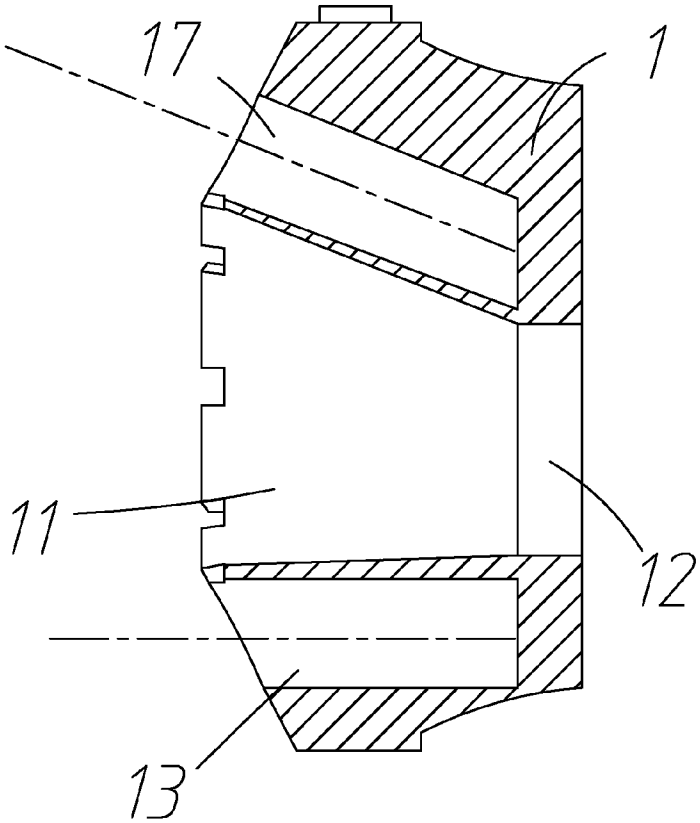
FIG. 4 is a longitudinal sectional view of a pod of an another embodiment.
Figure 3:
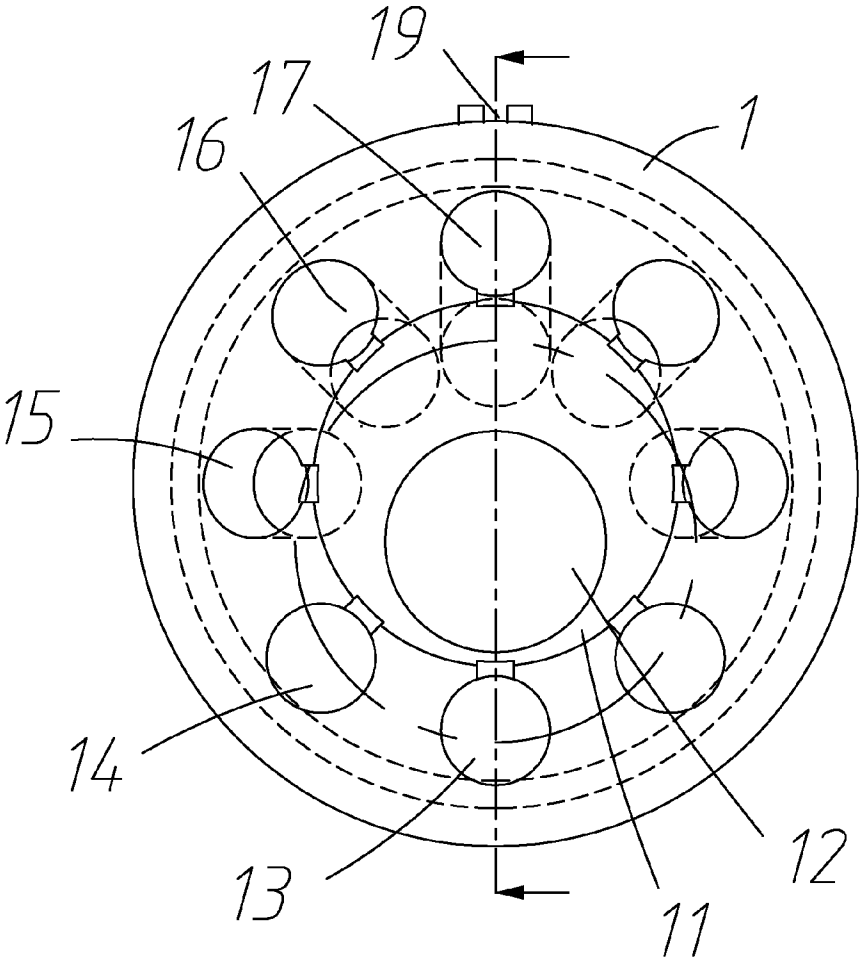
FIG. 3 is a front view of the pod of the net throwing device showing a first configuration of the pod.
Figure 4A:
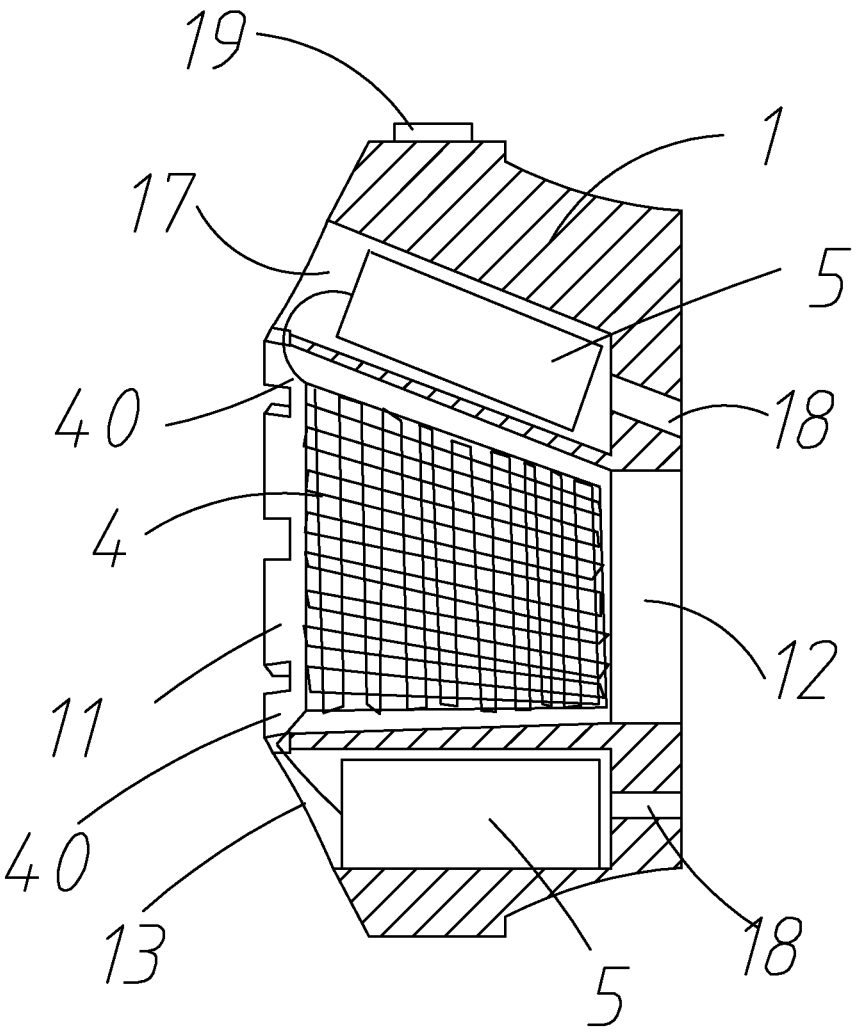
FIG. 4A is a longitudinal sectional view of the pod of FIG. 3 with the net disposed in the space and the weights disposed in the tubes respectively.
Figure 5:
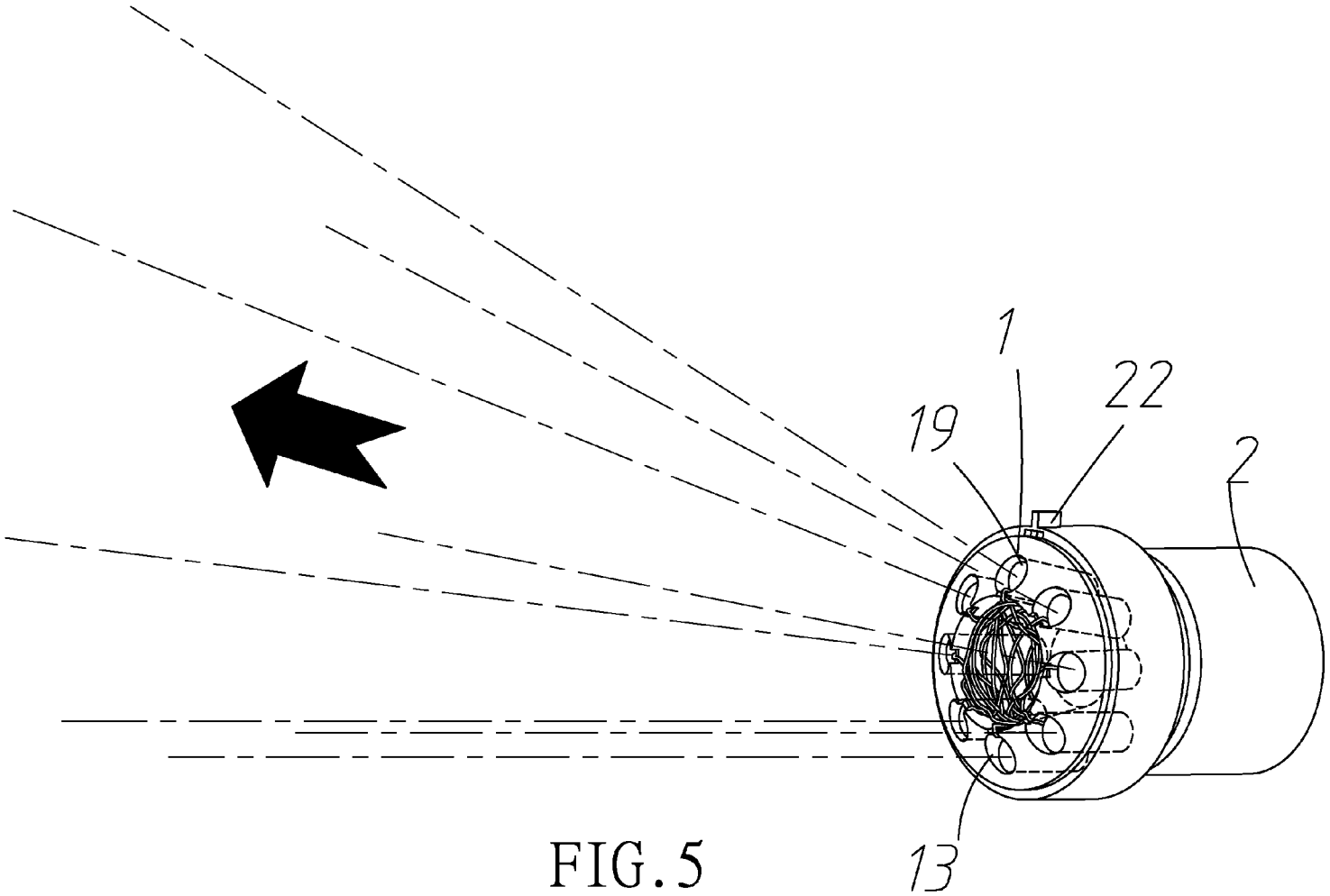
FIG. 5 is a perspective view of the net throwing device with the net about to launch.

Alternatively, the tunnels 18 are eliminated in another embodiment (see FIG. 4).

As shown in a first configuration (see FIG. 3), there are eight tubes in which the tubes 13, 14 and 15 are horizontal but the tubes 15 are offset at an angle from an axial axis of the channel 12, the tube 17 is inclined upward with respect to the tube 13, and the two tubes 16 are also inclined upward with respect to the tube 13 but have an inclined angle less than that of the tube 17.

Figure 6:
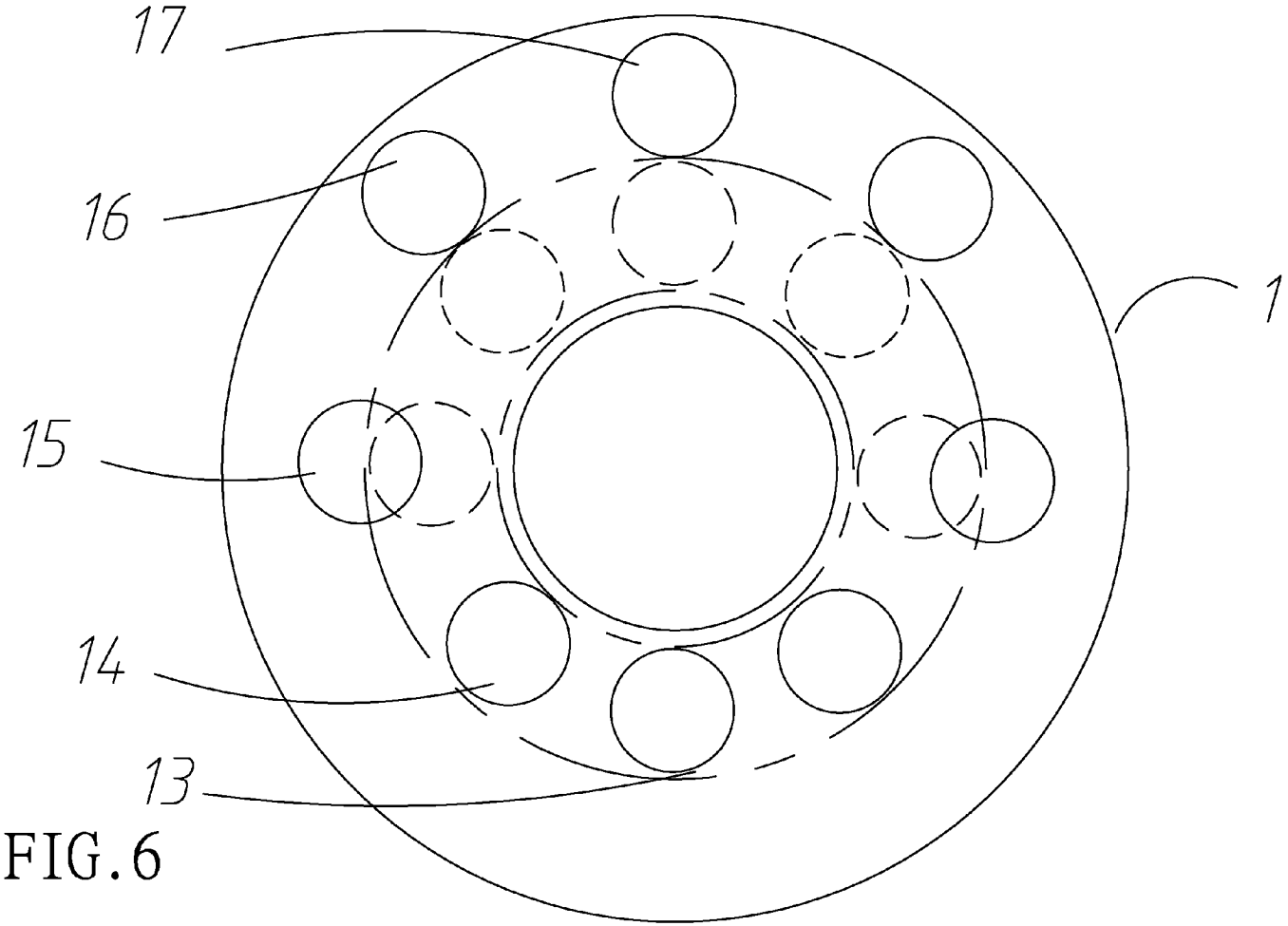
FIG. 6 is a front view showing a second configuration of the tubes.
Figure 6A:
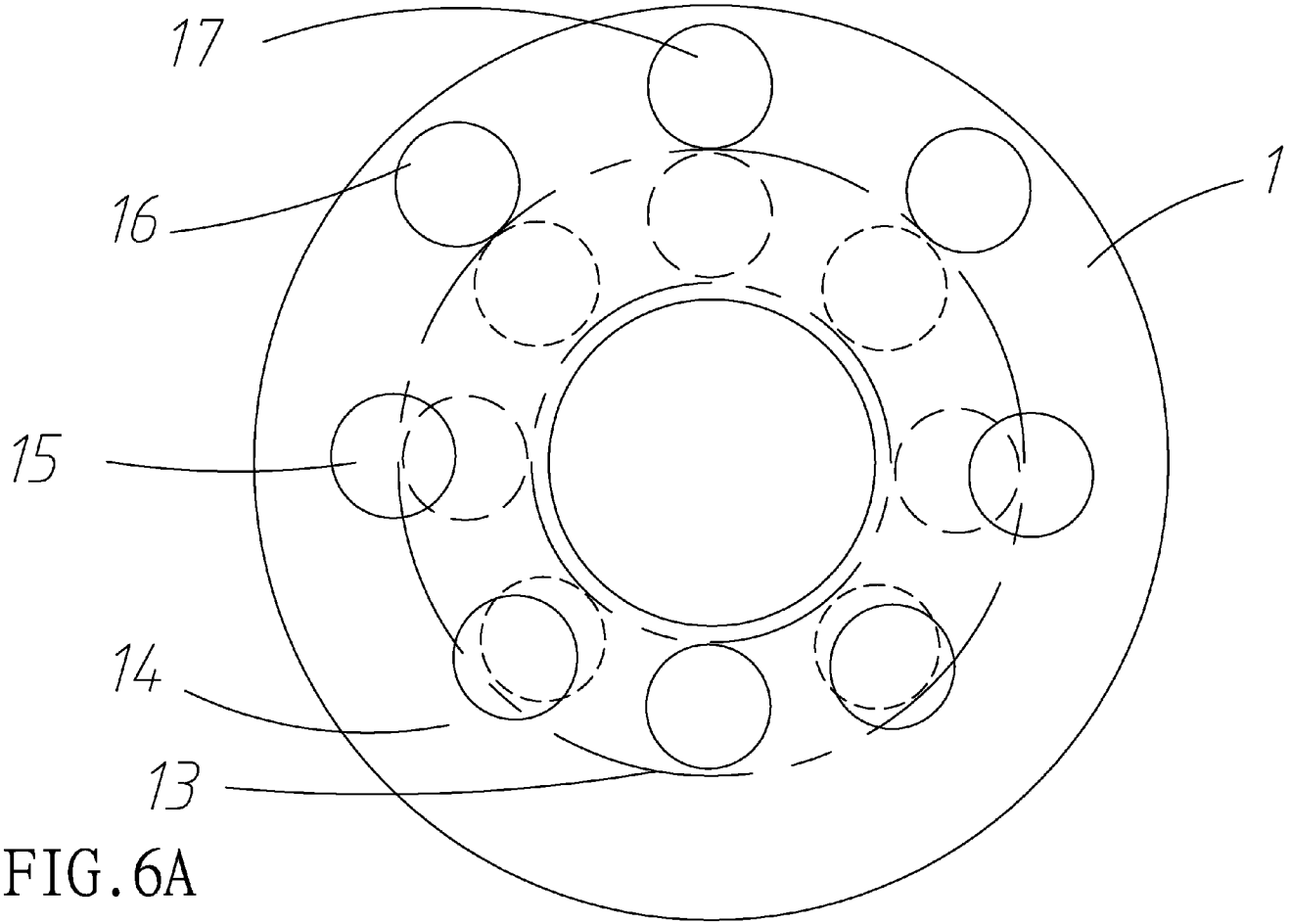
FIG. 6A is a front view showing a third configuration of the tubes.

As shown in a second configuration (see FIG. 6A), it is similar to the first configuration but lengths of the tubes 16 and 17 are different from that shown in the first configuration.

As shown in a third configuration (see FIG. 6A), it is similar to the first configuration in which the tube 13 is horizontal, the tubes 14 are inclined downward, the tubes 15 are horizontal and are offset at an angle from an axial axis of the channel 12, the tube 17 is inclined upward with respect to the tube 13, and the two tubes 16 are also inclined upward with respect to the tube 13 but have an inclined angle less than that of the tube 17.

Figure 6B:
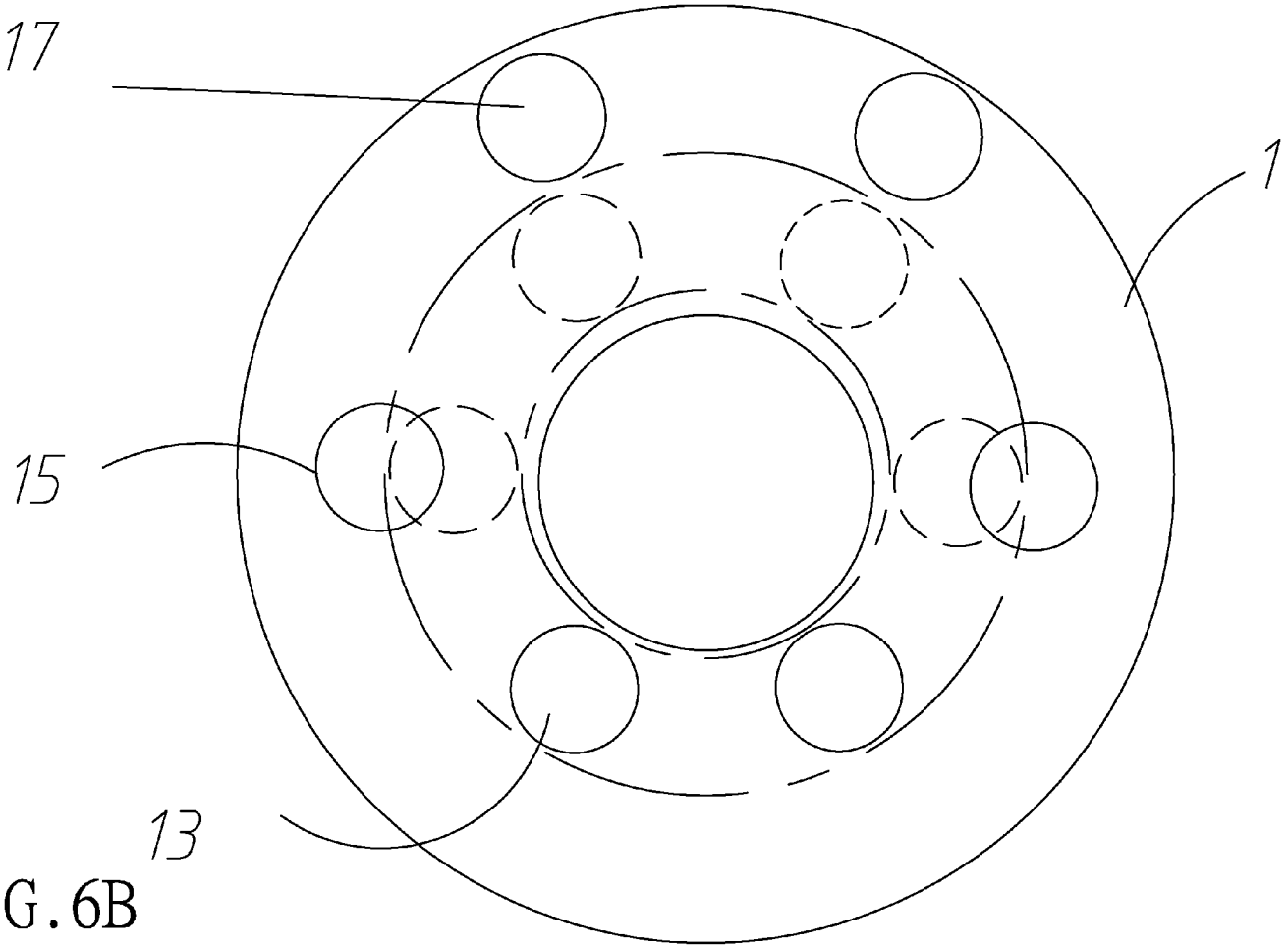
FIG. 6B is a front view showing a fourth configuration of the tubes.

As shown in a fourth configuration (see FIG. 6B), there are six tubes in which the tubes 13 and 14 are horizontal but the tubes 14 are offset at an angle from an axial axis of the channel 12, and the tubes 17 are inclined upward with respect to the tubes 13.

Figure 6C:
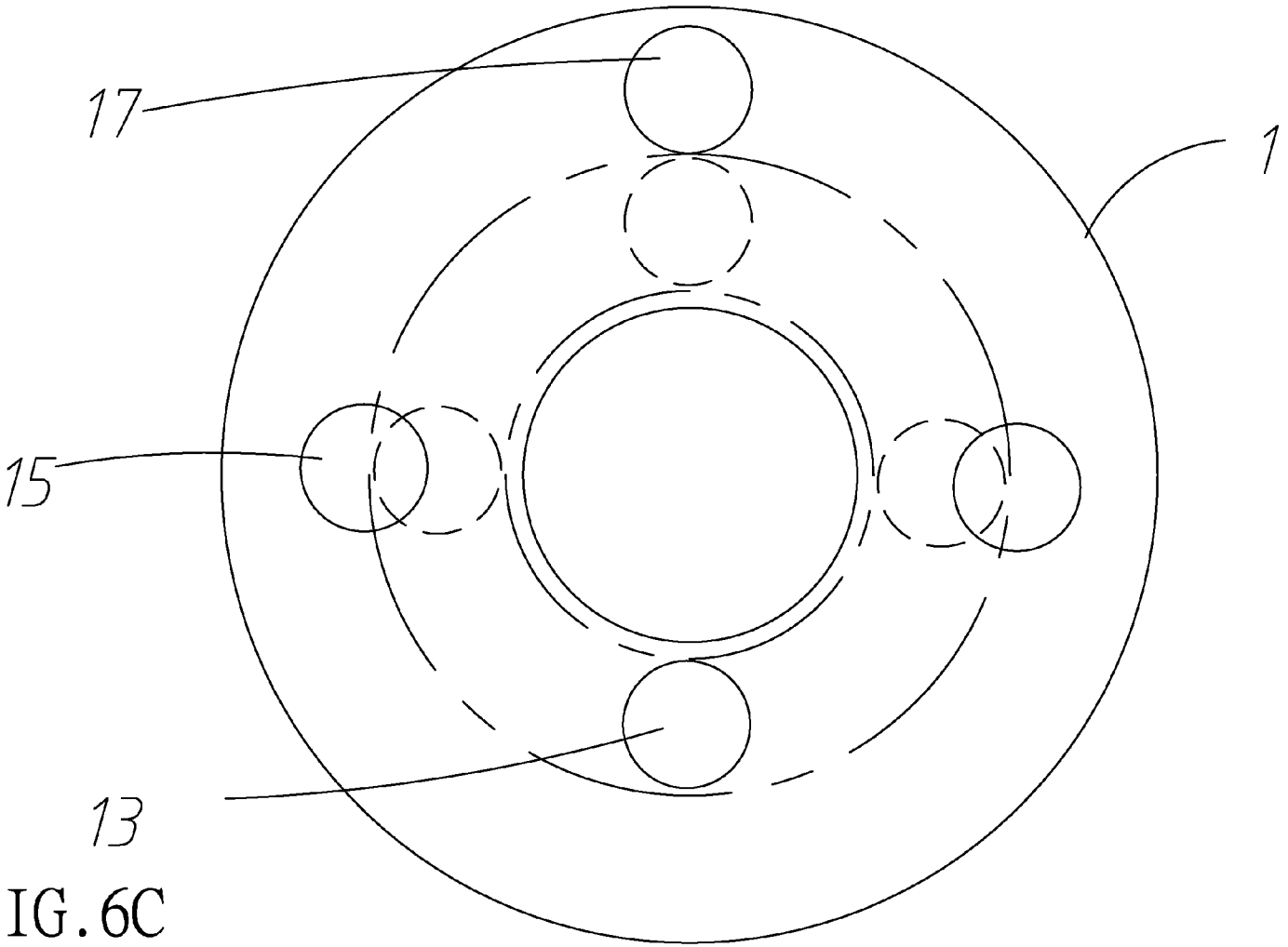
FIG. 6C is a front view showing a fifth configuration of the tubes.

As shown in a fifth configuration (see FIG. 6C), there four tubes in which the tube 13 is horizontal, the tubes 15 are horizontal and are offset at an angle from an axial axis of the channel 12, and the tube 17 is inclined upward with respect to the tube 13.

Figure 6D:
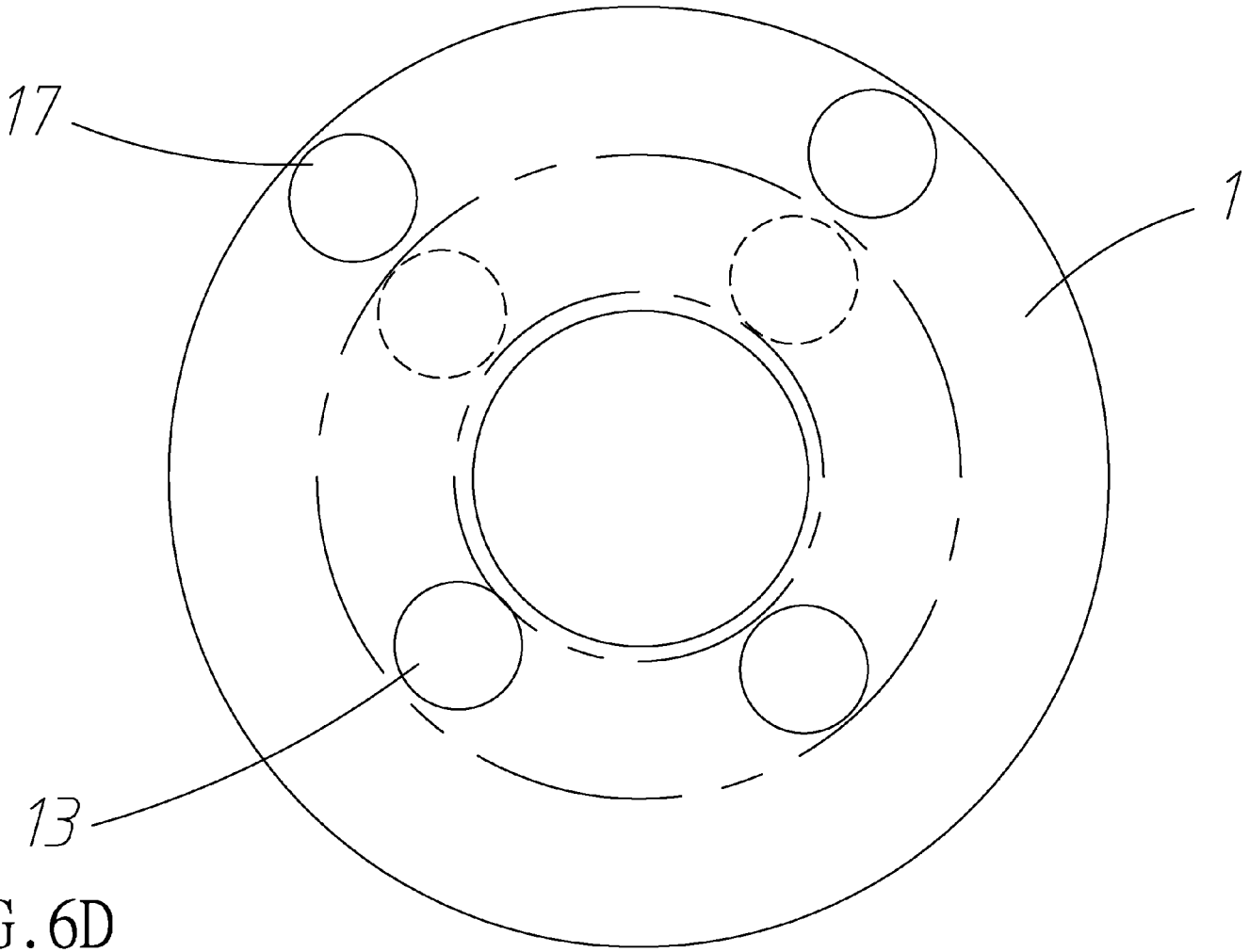
FIG. 6D is a front view showing a sixth configuration of the tubes.
Figure 7:
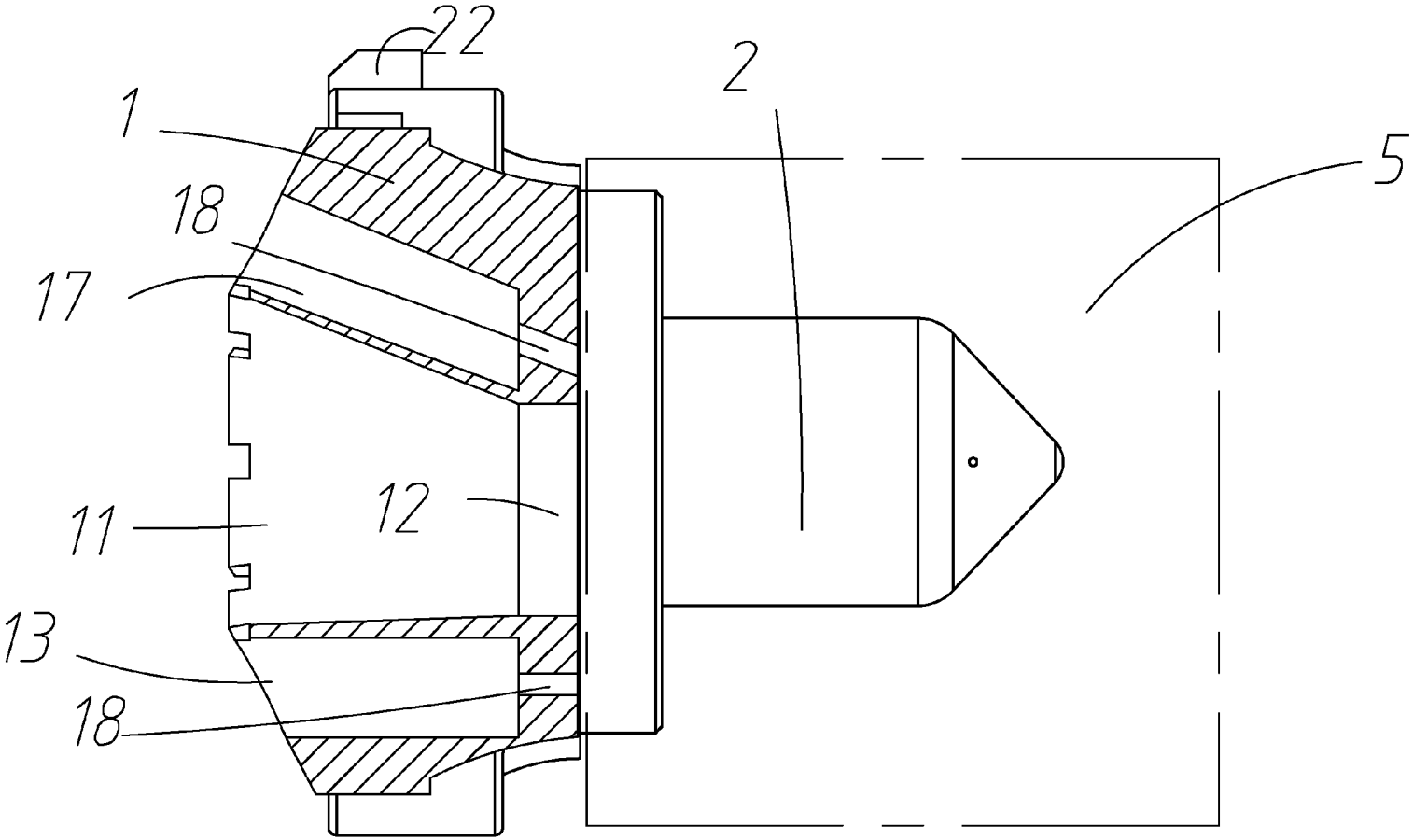
FIG. 7 is a side elevation in part of longitudinal section of the net throwing device and the launching device assembled.

As shown in a sixth configuration (see FIG. 6D), it is similar to the fifth configuration in which the tubes 13 are horizontal and the tubes 17 are inclined upward with respect to the tubes 13.

Figure 8:
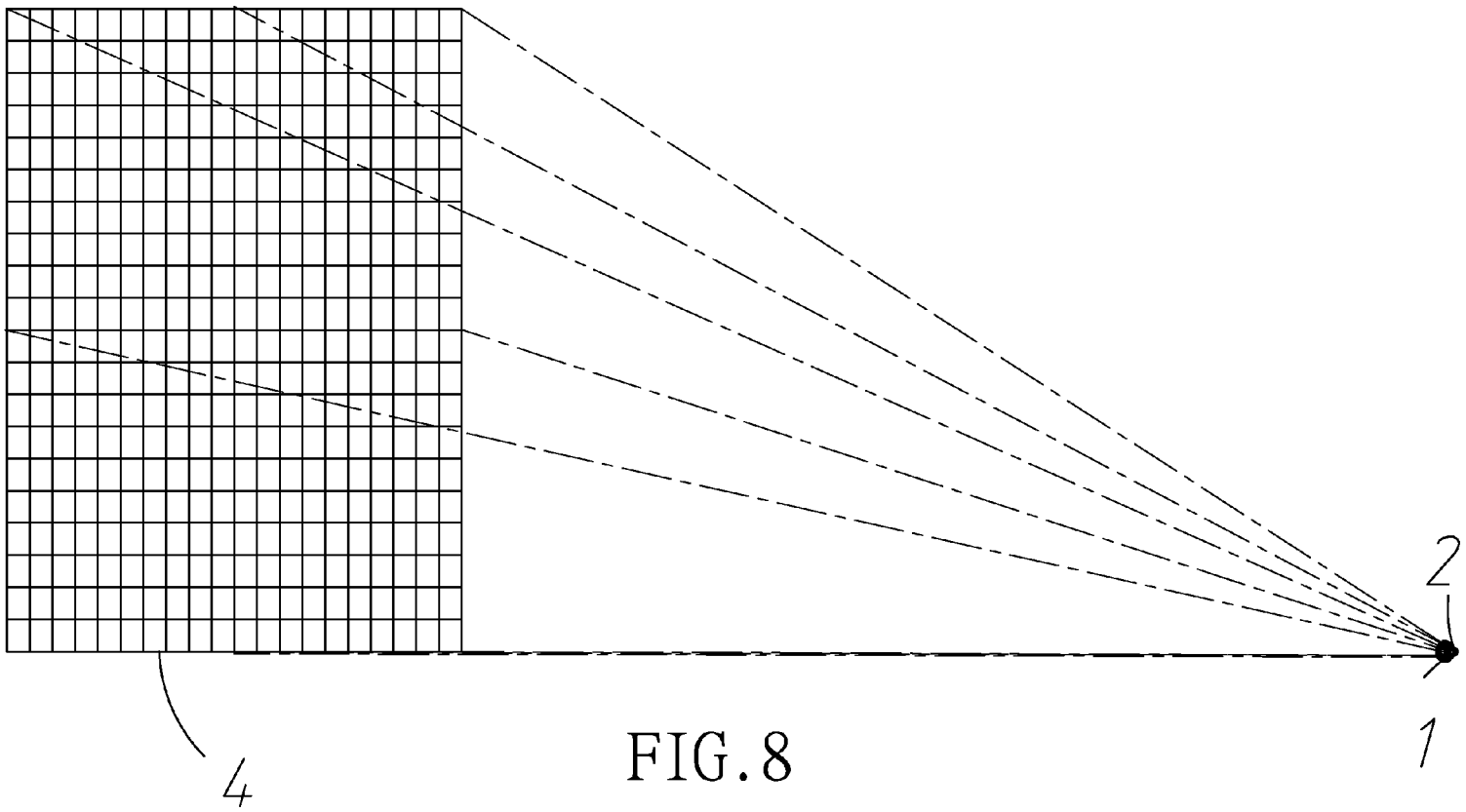
FIG. 8 is a side elevation showing the net projected out of the net throwing device.
Figure 8A:
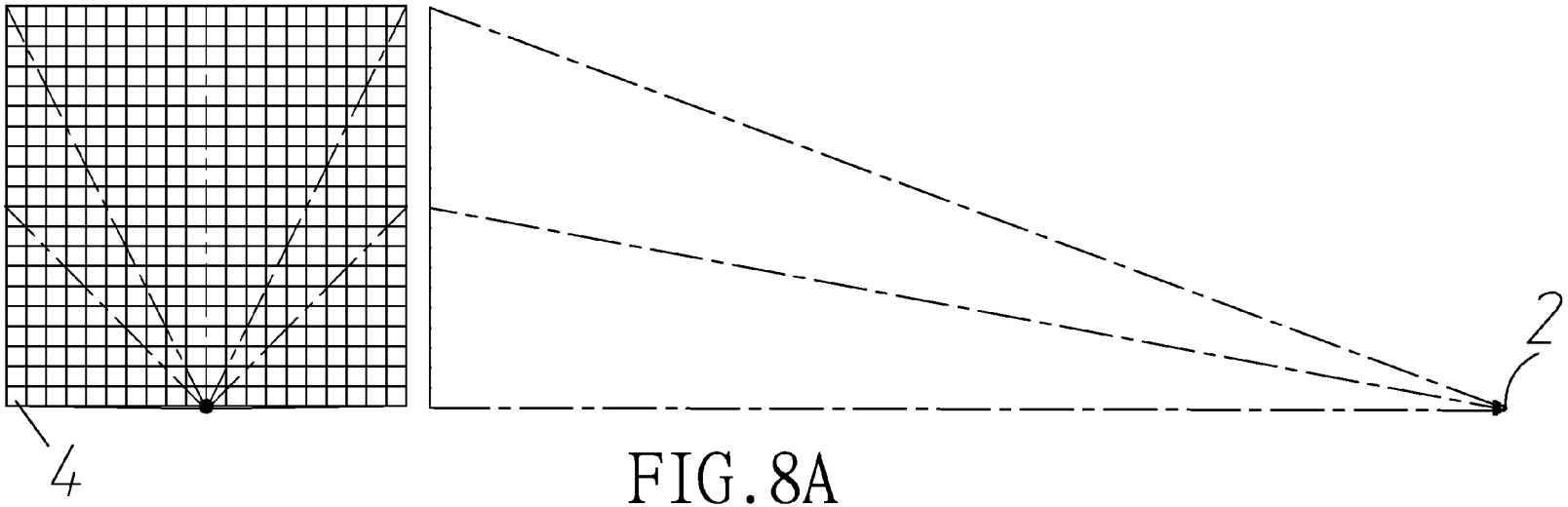
FIG. 8A is a front view of FIG. 8.
Figure 8B:
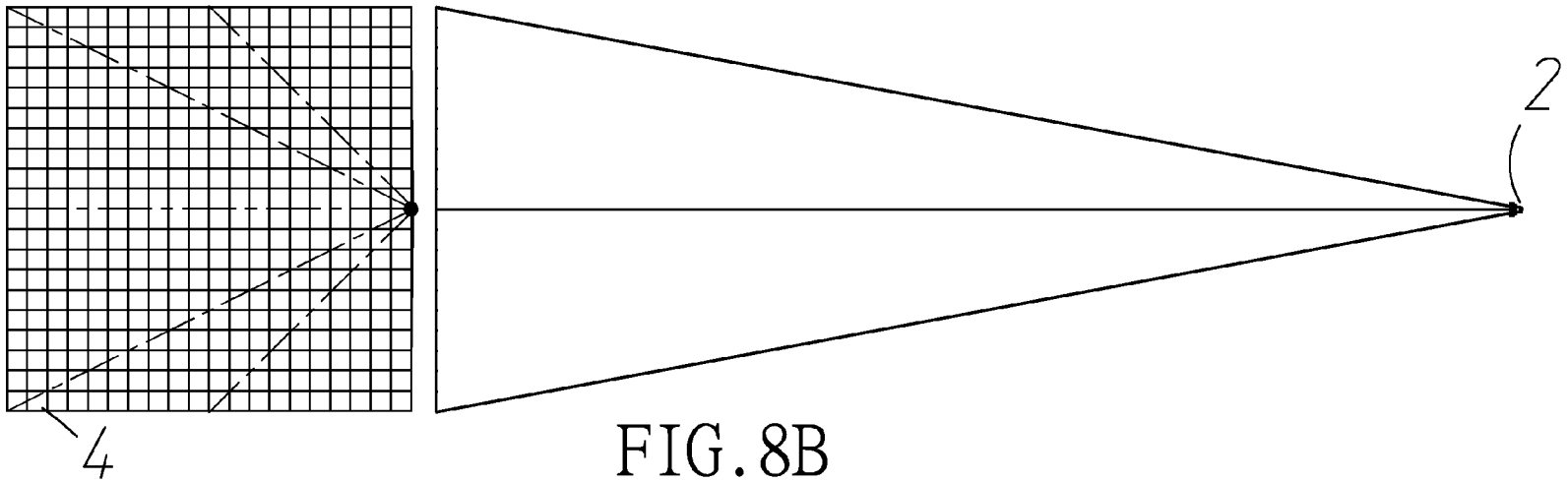
FIG. 8B is a top view of FIG. 8.

A hollow, cylindrical casing 2 comprises a forward oriented projection 21 on a front edge and adapted to fit in the slot 19, and an upward oriented protrusion 22 adjacent to the projection 21. The pod 1 is mounted in a head of the casing 2 which is in turn mounted in a launching device 5 in a ready to launch position (see FIG. 7). The launching device 5 can release compressed air to flow through the casing 2. And in turn, the compressed air flows to the channel 12 and the space 11, and flows to the tunnels 18 and the tubes 13 to 17 respectively. Finally, the compressed air projects the net 4 and the weights 5 out of the net throwing device to entangle target(s) (see FIGS. 8, 8A and 8B).

Figure 9:
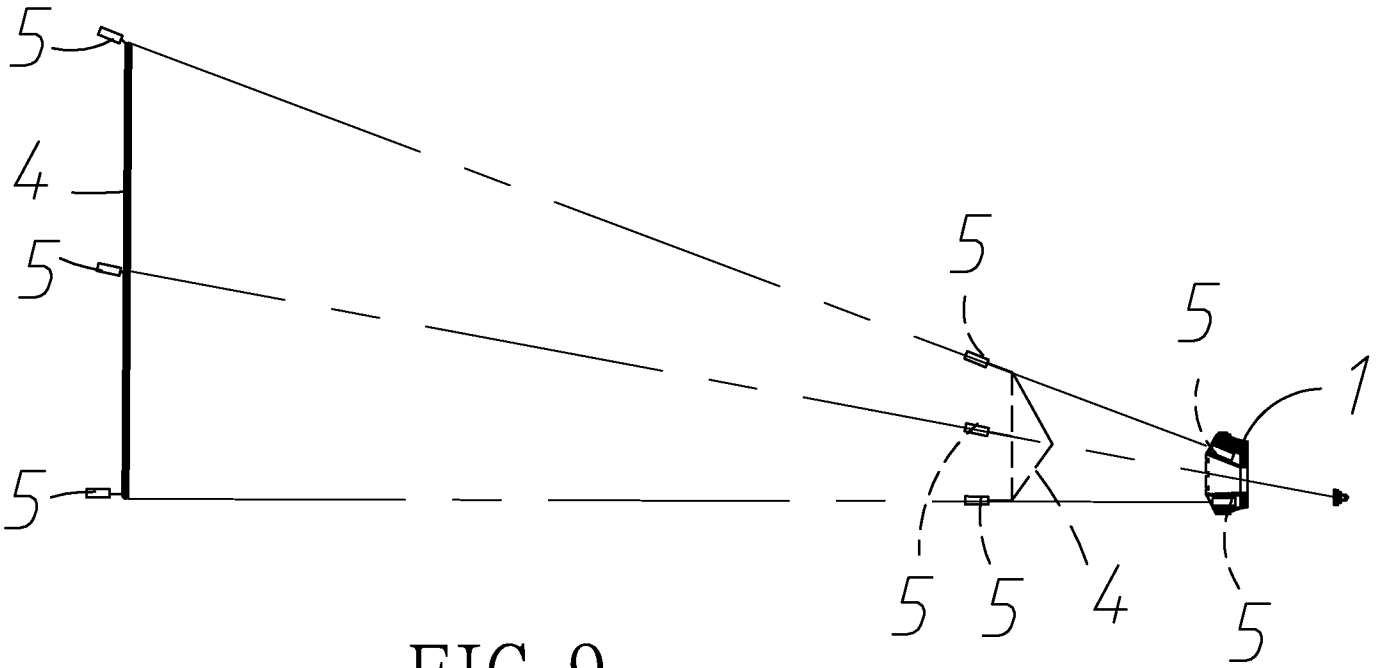
FIG. 9 is a side elevation in part of longitudinal section showing the net projected out of the net throwing device.
Figure 9A:
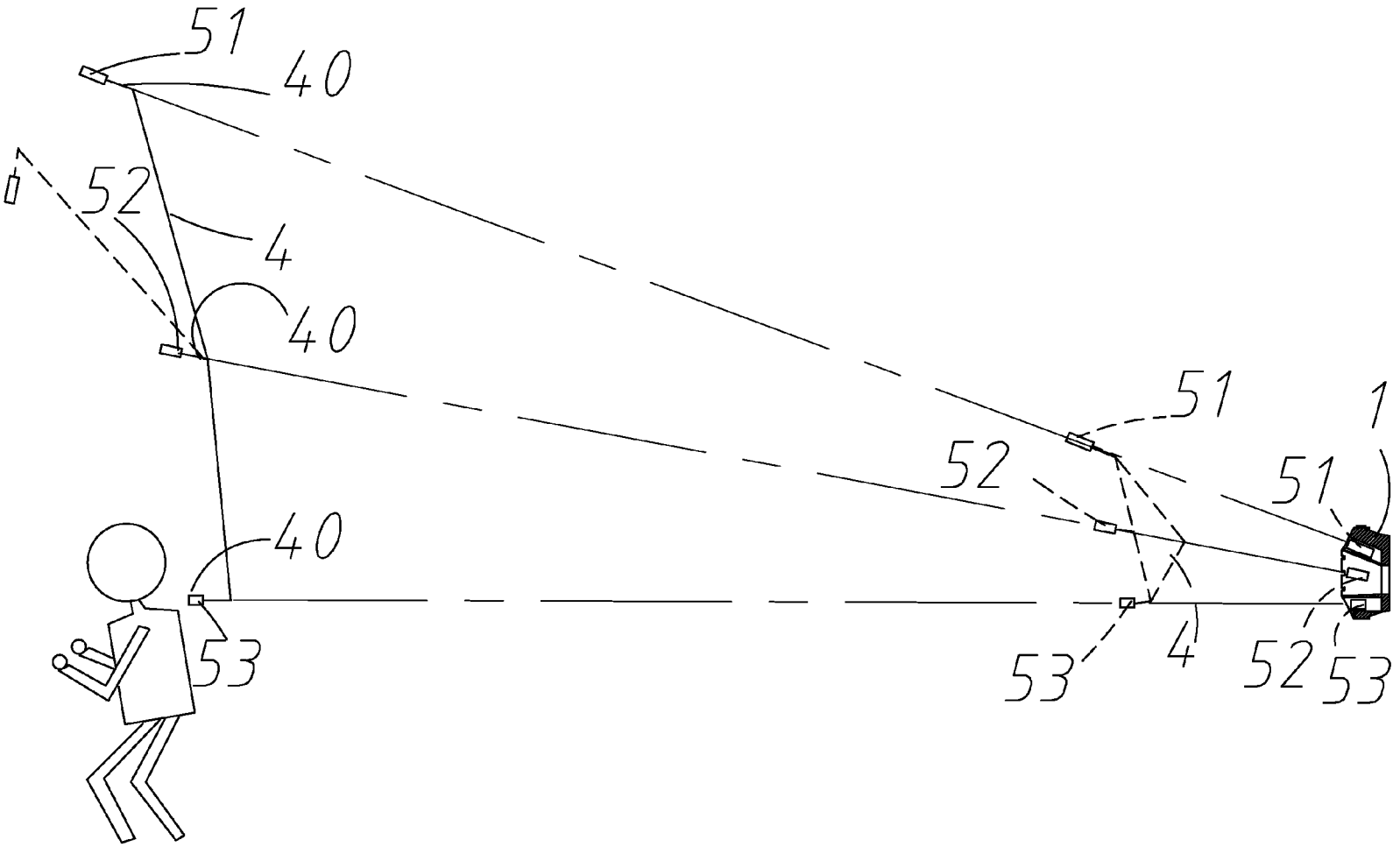
FIG. 9A is a view similar to FIG. 9 showing the net aiming at the shoulder of a person.

In operation, a law enforcement officer may fire the net throwing device from the shoulder (see FIG. 9). Further, the aim of the projected net 4 is the shoulder of a person (see FIG. 9A).

Figure 9B:
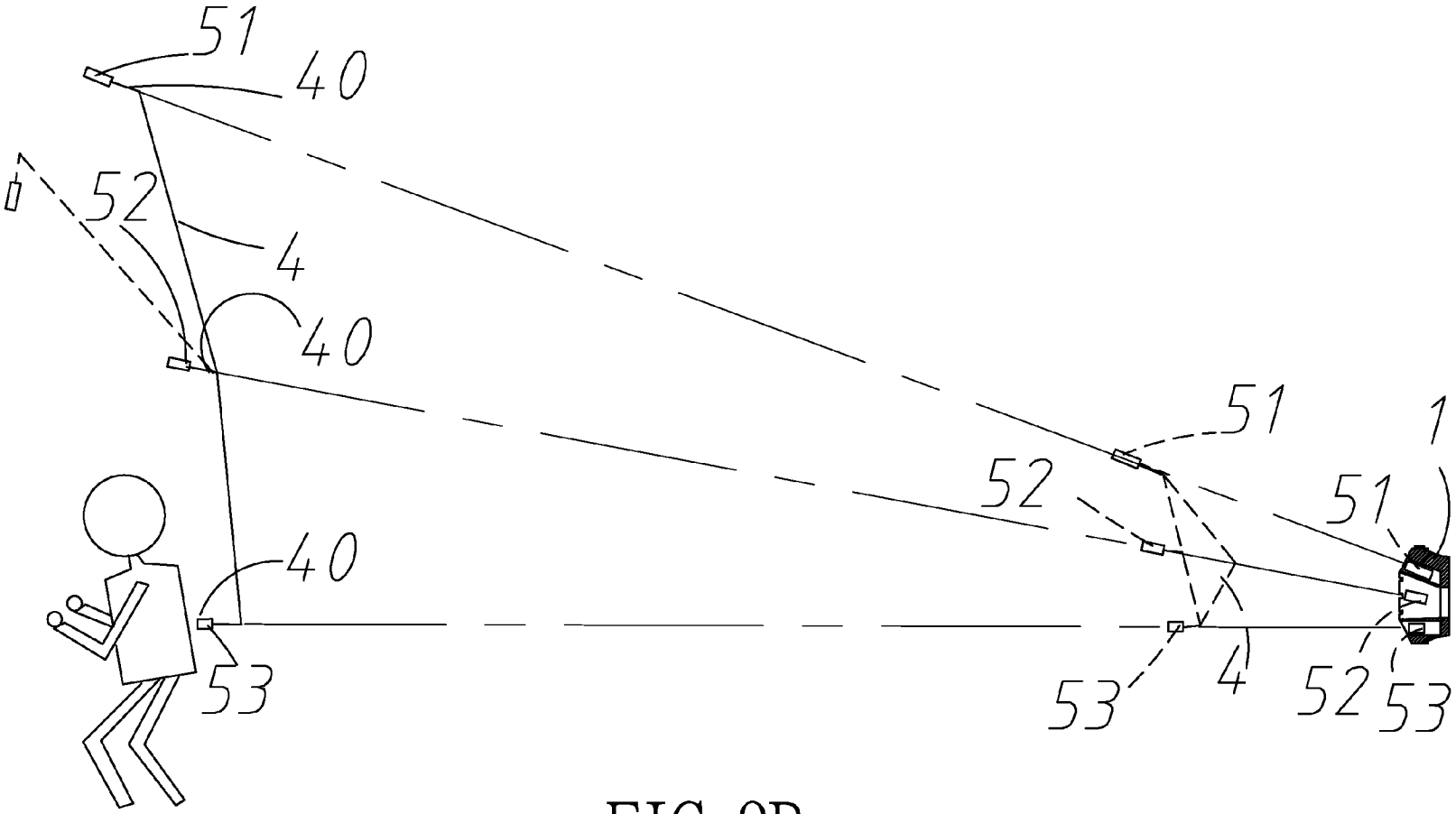
FIG. 9B is a view similar to FIG. 9 showing the net aiming at the lumbar region of the back of a person.

Alternatively, the law enforcement officer may fire the net throwing device from the lumbar region (see FIG. 9B). Further, the aim of the projected net 4 is the lumbar region of a person.

While the invention has been described in terms of preferred embodiments, those skilled in the art will recognize that the invention can be practiced with modifications within the spirit and scope of the appended claims.

What is claimed is:

1. A net throwing device comprising:

a pod, comprising an axial space with a shape of a frustum of an oblique cone, a plurality of tubes disposed around the axial space, and a slot formed on an edge;

a net disposed in the axial space;

a plurality of weights, separately disposed in the tubes, and a rope being connected between the net and each of the weights; and a casing, comprising a forward oriented projection on an edge of a front end, the forward oriented projection being fitted in the slot to secure the casing and the pod together, and a protrusion adjacent to the forward oriented projection;

wherein the casing communicates with the axial space.

2. The net throwing device of claim 1, wherein the casing further communicates with the tubes.

3. The net throwing device of claim 1, wherein the casing does not communicate with the tubes.

4. The net throwing device of claim 1, wherein any two of the weights are different in weight.

* * * * *